United States Patent [19]

Donaghy

[11] Patent Number: 4,960,308

[45] Date of Patent: Oct. 2, 1990

[54] SUPPORT SHELF FOR CRISPER DRAWERS IN REFRIGERATORS

[75] Inventor: David J. Donaghy, Gowen, Mich.

[73] Assignee: White Consolidated Industries, Inc., Cleveland, Ohio

[21] Appl. No.: 416,654

[22] Filed: Oct. 3, 1989

[51] Int. Cl.[5] ..... F25D 11/00

[52] U.S. Cl. ..... 312/214; 312/204; 312/242; 312/245; 248/235; 211/153; 211/134

[58] Field of Search ..... 248/235; 312/242, 245, 312/204, 214; 211/153, 134, 135, 186; 108/143, 102, 137, 27

[56] References Cited

U.S. PATENT DOCUMENTS

| | | | |
|---|---|---|---|
| 2,006,442 | 7/1935 | Connors | 211/153 X |
| 2,076,099 | 4/1937 | Smith et al. | 211/153 |
| 2,262,578 | 11/1941 | Ellis | 211/153 |
| 2,421,089 | 5/1947 | Smith | 211/153 |
| 2,549,879 | 4/1951 | Amore | 312/214 |
| 2,894,644 | 7/1959 | Magnuson | 211/186 X |
| 4,540,222 | 9/1985 | Burrell | 211/186 X |
| 4,580,852 | 4/1986 | Smittee et al. | 312/214 |
| 4,729,613 | 3/1988 | Tromble et al. | 211/153 X |
| 4,740,042 | 4/1988 | Stich et al. | 312/214 X |

*Primary Examiner*—David M. Purol

*Attorney, Agent, or Firm*—Pearne, Gordon, McCoy & Granger

[57] ABSTRACT

A crisper drawer support shelf for refrigerators assembled from four components. The assembly includes a molded plastic, generally rectangular frame having a tunnel along the front edge thereof. An extruded aluminum I-beam is press-fitted into the tunnel to provide strength along the front edge of the shelf. A transparent cover member is positioned within an opening defined by the frame. A sheet metal trim strip is snapped into its mounted position across the front of the shelf. The assembly can be installed as a unit. The I-beam provides sufficient strength to support crisper drawers carried by the support shelf.

9 Claims, 4 Drawing Sheets

SUPPORT SHELF FOR CRISPER DRAWERS IN REFRIGERATORS

BACKGROUND OF THE INVENTION

This invention relates generally to refrigerators, and more particularly to a novel and improved refrigerator shelf structure particularly suited for the support of crisper drawers and the like.

PRIOR ART

It is common to provide one or more crisper drawers along the lower portion of the food storage chamber of a refrigerator. Typically, such drawers are suspended on tracks formed in a support shelf which extends across the top of the crisper drawer. The support shelf functions as a drawer cover when the drawers are closed and supports the drawers in a cantilever fashion when the drawers are open. Therefore, the support shelf must provide sufficient strength to support the crisper drawers along with their contents, and also the food being stored on the top of the shelf.

Because the crisper drawers are supported in a cantilever fashion when the drawers are open, the front of the support shelf is subjected to a particularly high loading condition by open crisper drawers. Further, the front of the support shelf is sometimes exposed to very high loading when small children climb upon it trying to reach food stored on the upper shelves. Providing sufficient support shelf strength is particularly difficult when the shelf provides a glass or transparent center portion over the crisper drawers.

Some prior art support shelves for crisper drawers have been provided with a center leg at the front edge of the shelf. Such leg supports usually provide adequate strength but tend to become damaged or displaced. Further, they result in additional shelf components which must be manufactured and installed, thereby increasing the shelf cost.

In other instances, shelf strength is improved by roll-formed epoxy-coated beams along the front edge of the shelves.

SUMMARY OF THE INVENTION

There are several aspects to the present invention. In accordance with one important aspect of this invention, a novel and improved crisper drawer support shelf is provided in which only two structural elements are required for strength and these two structural elements are combined with only two additional components to provide an attractive crisper drawer support shelf having a transparent top and an attractive metal trim strip.

Further, the support shelf can be fully assembled, with the transparent top temporarily taped in place, for installation in the refrigerator as a unit. Since the shelf requires only four parts, and can be assembled and installed as a unit, the manufacturing and labor costs are minimized.

Another important aspect of this invention involves the use of an extruded aluminum I-beam along the front edge of the support shelf to provide the required strength. The I-beam structure provides high strength in a vertical direction with a minimum material cost. Because it is formed of aluminum, a protective anticorrosion coating is not required.

The principal structural component of the shelf is a generally rectangular, molded plastic frame having an integral tunnel portion along its forward edge. This tunnel is sized and shaped to receive the I-beam with a tight fit. Therefore, the frame and beam are assembled by merely pushing the I-beam into the tunnel, where friction holds it in place without separate fasteners or the like. When installed, the I-beam is concealed from view by the frame.

Molded into the frame are opposed track portions which support the crisper drawers for movement between the closed and open position. The frame is also recessed to receive and support a transparent cover insert. Lastly, a sheet metal trim strip is snapped into its mounted position along the forward edge of the support shelf.

These and other aspects of this invention are illustrated in the accompanying drawings and are more fully described in the following specification.

DETAILED DESCRIPTION OF THE DRAWINGS

Figure 1:
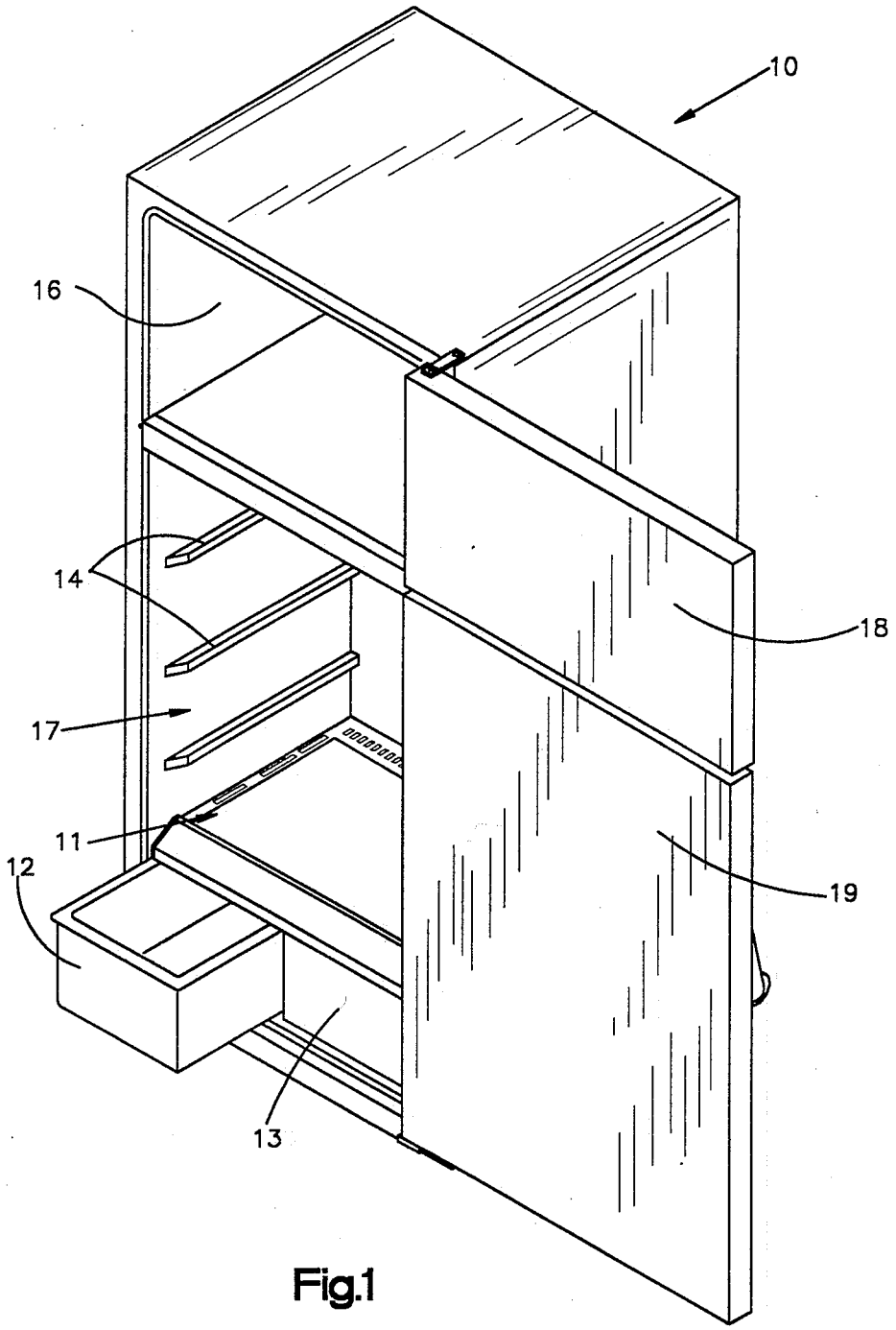
FIG. 1 is a schematic, perspective view of a typical refrigerator having a crisper drawer support shelf incorporating the present invention installed therein.

FIG. 1 schematically illustrates a typical two-door refrigerator 10 having a crisper drawer support shelf 11 installed therein. The shelf 11 supports two crisper drawers 12 and 13. The drawer 12 is illustrated in the open position in which it is cantilever-supported by the shelf 11 and the drawer 13 is illustrated in the closed position in which it is covered by the shelf 11.

The crisper drawer shelf 11 and the additional shelves, usually provided above the crisper drawer support shelf, are supported on shelf supports formed in the cabinet wall of the refrigerator and schematically illustrated at 14. For purposes of illustration to simplify the understanding of the drawings, shelves are not illustrated above the crisper drawer support shelf 11.

The illustrated embodiment provides a freezer compartment 16 and a nonfreezing storage compartment 17. The crisper drawers 12 and 13 are suspended from the crisper drawer support shelf 11 at the bottom of the compartment 17. An upper door 18 is provided for the freezer compartment 16 and a lower door 19 is provided for the nonfreezing storage compartment 17.

Figure 2:
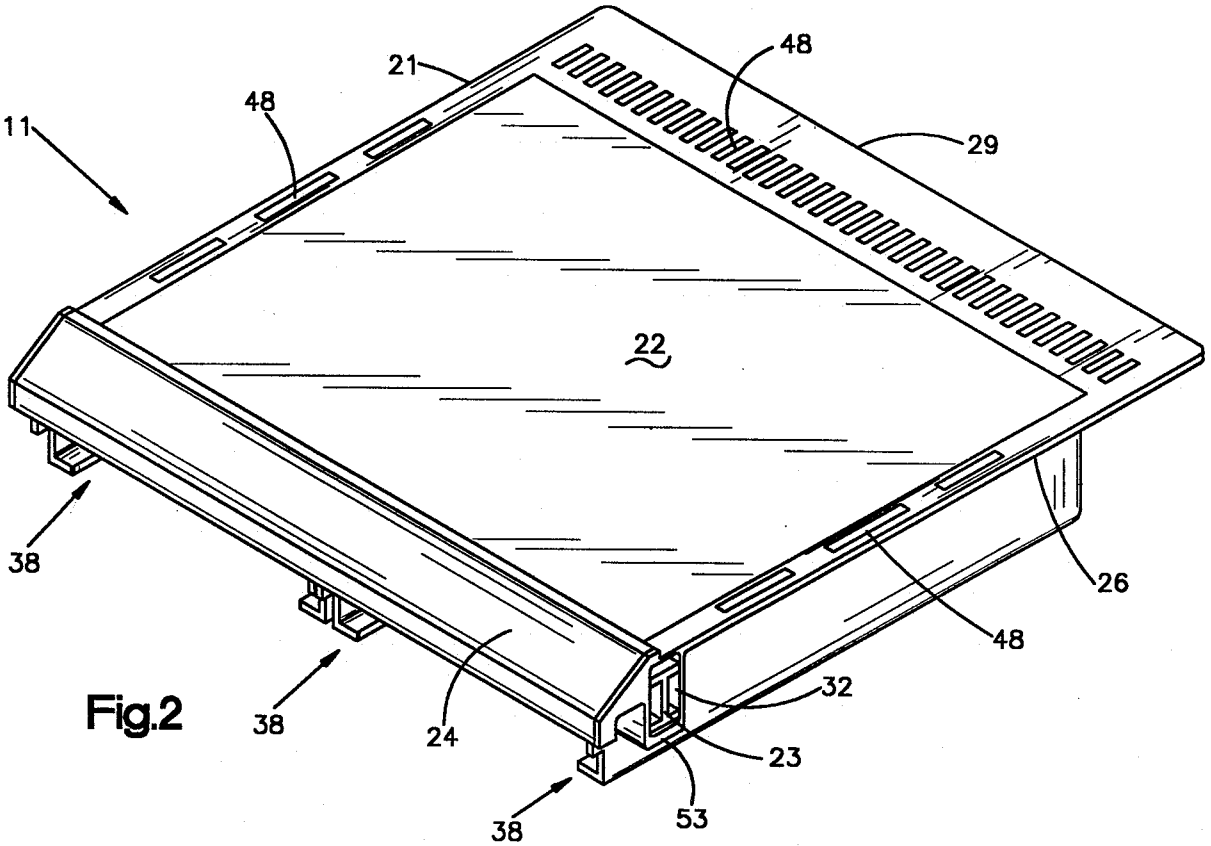
FIG. 2 is an enlarged, fragmentary, perspective view of the assembled crisper drawer support shelf illustrated in FIG. 1 prior to its installation in a refrigerator.
Figure 3:
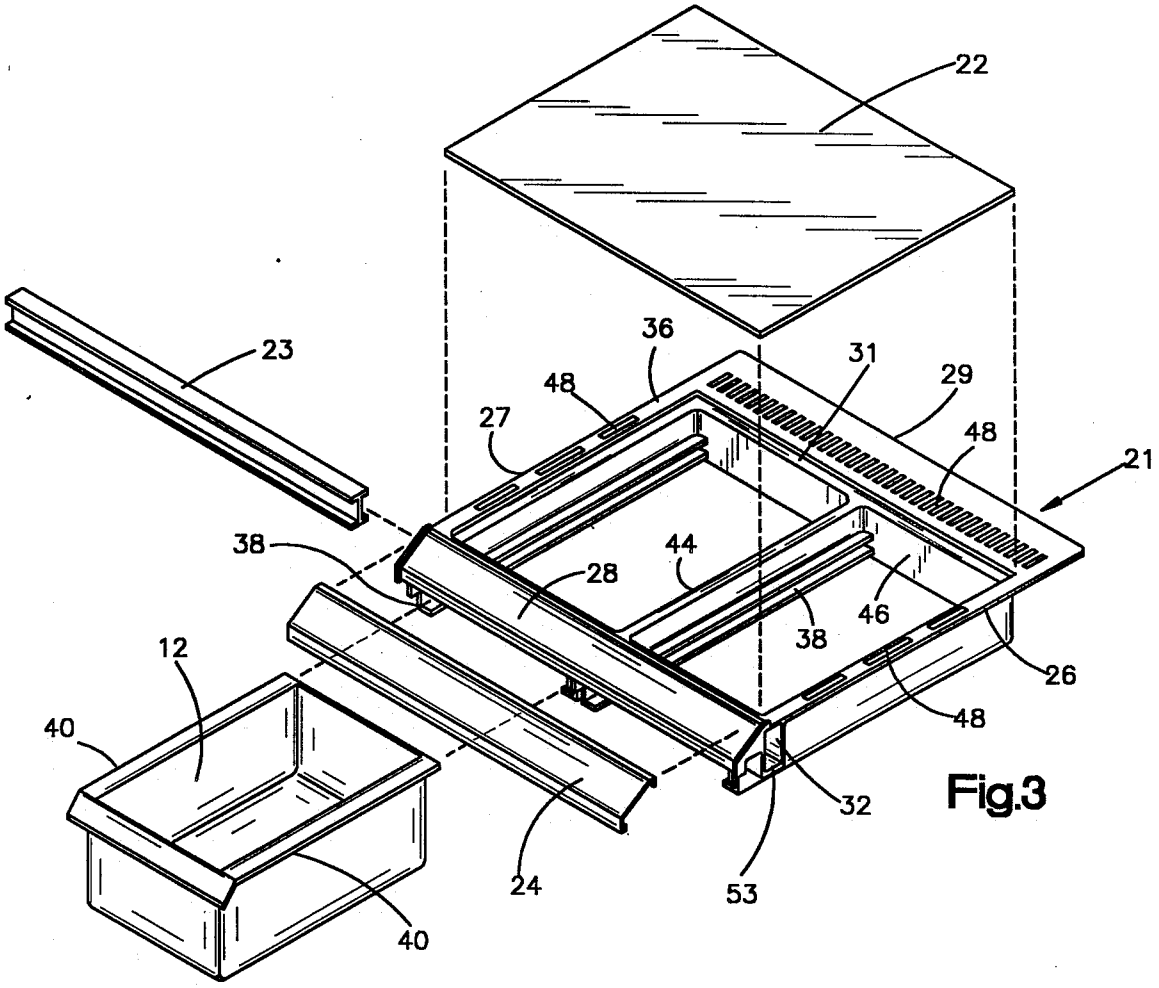
FIG. 3 is an exploded, perspective view of the crisper drawer support shelf of FIG. 2 illustrating the components prior to assembly.

Referring now to FIGS. 2 and 3, the crisper drawer support shelf 11 requires only four component parts. The four parts are a molded plastic frame 21, a transparent drawer cover and shelf 22, an extruded aluminum I-beam 23, and a sheet metal trim strip 24.

The frame 21 is generally rectangular in shape providing opposed side wall portions 26 and 27 and opposed front and back wall portions 28 and 29, respectively. The various wall portions cooperate to define an open center in which the transparent drawer cover and shelf 22 is positioned. In order to support and position the transparent shelf 22, the frame is provided with recessed support flanges 31 extending entirely around the opening so that the upper surface of the transparent shelf 22 is flush with the adjacent surfaces of the various wall portions 26 through 29.

In order to provide sufficient strength along the front wall portion 28, such portion of the frame is formed with a tunnel 32 extending the full width of the front of the frame sized to receive the I-beam 23 with a tight fit. During the assembly of the shelf, the I-beam is pressed endwise into the tunnel 32. Once installed, the tight fit between the surface of the tunnel and the I-beam is sufficient to maintain the I-beam in its assembled position without separate fastening means of any type.

The fourth and the last part of the crisper drawer support shelf 11 is a sheet metal trim strip 24 which snaps in position along the front wall portion 28 and provides an aesthetically attractive trim for the shelf. The trim strip 24, however, does not materially contribute to the strength of the assembly and the frame 21, in cooperation with the I-beam, provides the structural strength for supporting the crisper drawers 12 and 13. The transparent shelf member 22 provides sufficient strength in cooperation with the frame 21 to support the items which are stored on the shelf. However, the shelf member 22 does not contribute to the support of the crisper drawers 12 and 13. Normally the shelf 22 is formed of tempered glass or the like but it may also be formed of a transparent plastic material.

Referring now to FIGS. 1 through 6, the frame 21 provides an upper horizontal surface 36 along each side portion 26 and 27 which is raised with respect to the support flange surface 31 so that the surfaces 36 are flush with the upper surface of the transparent shelf portion 22 when such portion is installed. Extending downwardly from the inner edge of the side wall flange portions 31 is a vertical wall portion 37 of substantial depth to provide stiffness to the frame and also to support the track 38 consisting of upper and lower track portions 39 and 41, respectively. These track portions 39 and 41 are vertically spaced to receive a flange 40 (illustrated in FIG. 3) along the adjacent edge of the crisper drawers 12 and 13. Since the lower track portion 41 provides a principal structure for supporting the weight of the associated crisper drawer, it is provided with strengthening gussets 43 at intervals along its length.

In the illustrated embodiment, the frame is provided with a center wall portion 44 which extends between the front and back wall portions 28 and 29 along the centerline of the frame. This wall portion 44 is provided with tracks 41 along both sides thereof to support the adjacent edges flanges 40 of both of the crisper drawers 12 and 13. Also, the top surface of the center wall portion 44 supports the center of the transparent shelf member 22. The frame also provides a relatively deep wall 46 immediately behind the tracks 38 which extends the full width of the frame. This wall 46 functions as a beam to support the rearward end of the crisper drawers and the adjacent surface of the frame. Because this wall 46 can be relatively deep, additional strengthening beam systems are not required. Rearwardly of the beam portion 46 are relatively shallow beam portions 47 which extend laterally across the frame along the rearward side thereof. Since this portion of the frame does not support the crisper drawers, relatively shallow beam portions 47 are adequate.

Openings 48 are provided along the sides and the back of the frame to ensure that air can circulate past the shelf and provide adequate cooling of the crisper drawers themselves.

Figure 4:
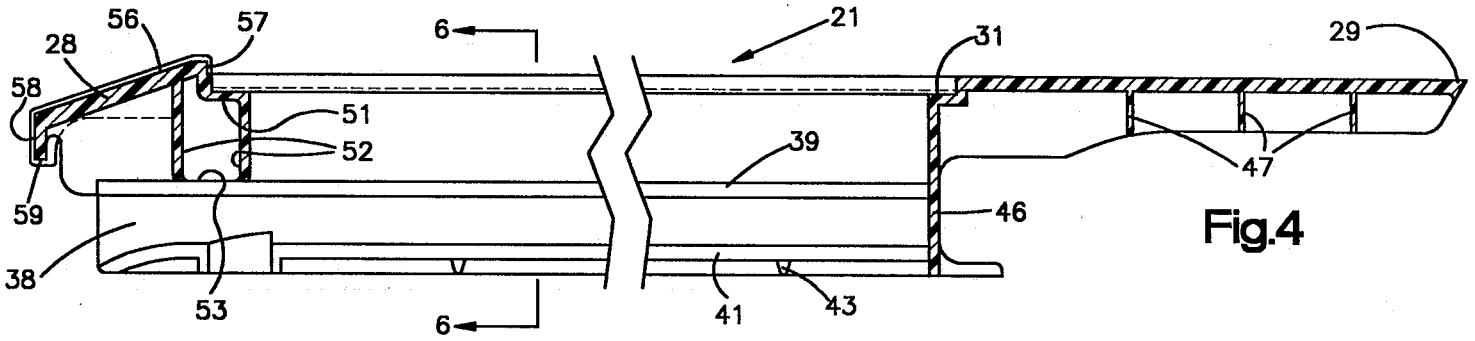
FIG. 4 is a cross section taken along one side of the frame member, illustrating the tunnel for the I-beam and one track structure for supporting the crisper drawers.
Figure 5:
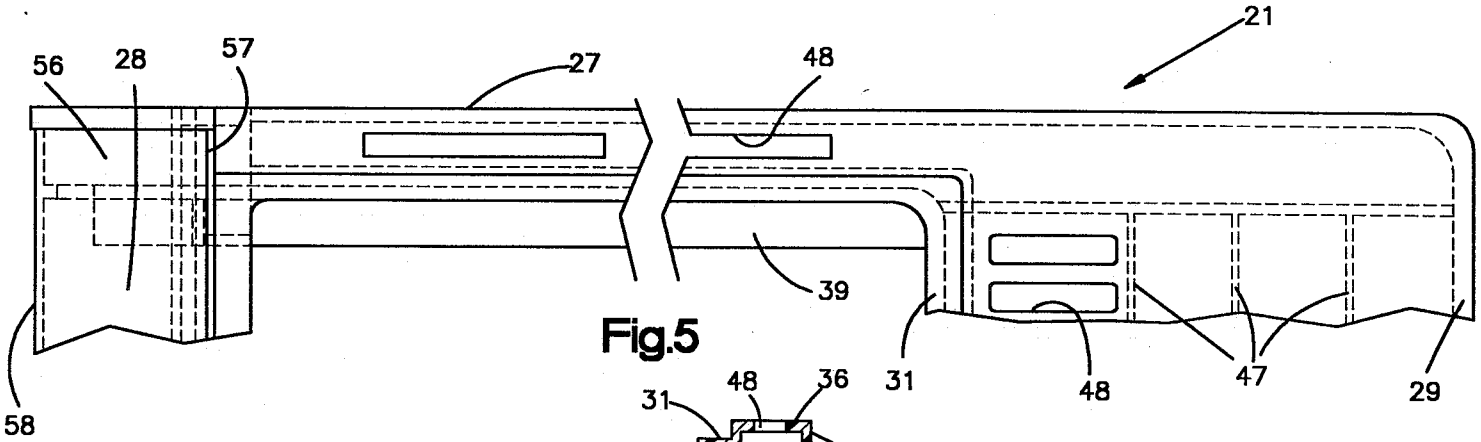
FIG. 5 is a fragmentary plan view of the frame member.
Figure 6:
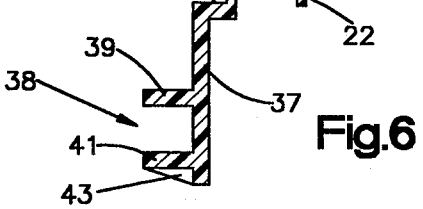
FIG. 6 is a fragmentary cross section taken along line 6—6 of FIG. 4.

The tunnel 32 provides top and side walls 51 and 52, respectively, extending completely across the frame, but provides a bottom wall 53 only adjacent to the ends as illustrated in FIGS. 3 and 4 and at the center wall portion 44. By eliminating the bottom walls in mid-span between the side wall portions and the center wall portions 44, material savings are accomplished. Since any load on the I-beam by the shelf along portions spaced from the ends of the I-beam are in a downward direction, the mid-span elimination of the lower wall does not affect the support of the shelf provided by the I-beam. The I-beam is concealed from view, from the front, back, and above, by the frame 21.

The front wall portion 28 provides an inclined wall portion 56 extending to a rearward vertical wall portion 57 and a forward vertical wall portion 58. This wall portion 58 terminates at a lower edge 59. The trim strip 24 is formed of decorative sheet metal and snaps over the vertical wall portion 57 at the rearward edge and under the edge 59 at its forward edge to secure it in its mounted position without separate fastening means. If desired, the shelf can be assembled from only three pieces without a forward trim strip 24, since the trim strip does not perform any material structural function in the shelf assembly.

Tests have been conducted on the I-beam formed of full hardened structural aluminum extruded in the form of an I-beam having a depth of slightly less than ¾", a flange width of ½", and a flange thickness of about 3/32". Such tests establish that a loading of about 132 pounds did not result in failure of the beam when loaded in accordance with standard test procedures for such shelf structures. By utilizing an extruded aluminum I-beam which does not require separate coating, a very efficient structural system is provided which requires less material than most alternate structures. Further, because the entire shelf system can be assembled separately and installed as a unit, labor savings of substantial amounts are achieved.

Although the preferred embodiment of this invention has been shown and described, it should be understood that various modifications and rearrangements of the parts may be resorted to without departing from the scope of the invention as disclosed and claimed herein.

What is claimed is:

1. A crisper drawer support shelf for refrigerators comprising a generally rectangular frame member providing side portions and front and back portions, said frame member being structured to be supported along the side walls of a refrigerator cabinet, said frame member providing a tunnel-like opening extending along said front portion, a metal I-beam positioned in said tunnel opening providing said front portion of said frame member with sufficient strength to support loads thereon, said frame member obscuring said I-beam from view from in front and above, said frame member providing opposed tracks for supporting a crisper drawer and allowing said drawer to be moved from a closed position under said shelf to an open forward position, said tunnel providing a bottom wall at its ends operating to anchor the ends of said I-beam, said tunnel providing an open bottom wall along at least some portions intermediate its ends.

2. A crisper drawer support shelf as set forth in claim 1, wherein said I-beam is formed of corrosion-resistant material eliminating any requirement for corrosion-resistant coatings thereon.

3. A crisper drawer support shelf as set forth in claim 1, wherein said I-beam is an extruded aluminum I-beam.

4. A crisper drawer support shelf as set forth in claim 1, wherein said frame member provides a central opening and a transparent member positioned in said opening.

5. A crisper drawer support shelf as set forth in claim 4, wherein said frame member is molded plastic.

6. A crisper drawer support shelf as set forth in claim 5, wherein said frame member provides two pairs of tracks operable to support two crisper drawers.

7. A crisper drawer support shelf as set forth in claim 4, including a sheet metal decorative trim strip mounted along said front portion of said frame member.

8. A refrigerator comprising a cabinet defining a portion of a refrigerated food storage compartment, a crisper drawer support shelf mounted in said chamber adjacent the lower end thereof, and a plurality of crisper drawers supported on said crisper drawer support shelf for movement between a closed position in which they are covered by said support shelf and an open position extending forwardly therefrom, said support shelf including a molded plastic frame member providing side portions and front and back portions, said frame member providing opposed pairs of tracks supporting an associated of said crisper drawers, said frame member defining a generally rectangular opening along the upper surface thereof, a transparent cover member supported in said opening, a decorative strip of sheet material mounted on said front portion of said frame member, said frame member providing a tunnel-like opening extending along said front portion, and an extruded aluminum I-beam positioned in said tunnel opening providing said front portion of said frame member with sufficient strength to support loads thereon, said frame member obscuring said I-beam from view from in front and above.

9. A refrigerator as set forth in claim 8, wherein said I-beam is positioned in said tunnel without separate fasteners and said trim strip is a metal strip snapped into position without separate fasteners.

* * * * *